US009879192B2

(12) United States Patent
Watermeyer De Wet et al.

(10) Patent No.: US 9,879,192 B2
(45) Date of Patent: Jan. 30, 2018

(54) PROCESS FOR PRODUCING JET FUEL FROM A HYDROCARBON SYNTHESIS PRODUCT STREAM

(71) Applicants: Sasol Technology (PTY) Ltd., Sasolburg (ZA); Axens, Rueil Malmaison (FR)

(72) Inventors: Ewald Watermeyer De Wet, Vanderbijlpark (ZA); Pata Clair Williams, Vanderbijlpark (ZA); Stéphane Fedou, Paris (FR); Marielle Gagniere, Bougival (FR)

(73) Assignees: SASOL TECHNOLOGY (PTY) LTD., Sasolburg (ZA); AXENS, Rueil Malmaison (FR)

( * ) Notice: Subject to any disclaimer, the term of this patent is extended or adjusted under 35 U.S.C. 154(b) by 746 days.

(21) Appl. No.: 14/254,783

(22) Filed: Apr. 16, 2014

(65) Prior Publication Data

US 2014/0316173 A1 Oct. 23, 2014

(30) Foreign Application Priority Data

Apr. 16, 2013 (EP) ..... 13001989

(51) Int. Cl.

| | |
|---|---|
| ***C10G 11/00*** | (2006.01) |
| ***C10L 1/04*** | (2006.01) |
| ***C10G 69/00*** | (2006.01) |
| ***C10G 29/20*** | (2006.01) |
| ***C10G 47/00*** | (2006.01) |
| ***C10G 50/00*** | (2006.01) |
| ***C10G 9/00*** | (2006.01) |

(52) U.S. Cl.

CPC ..... *C10L 1/04* (2013.01); *C10G 9/00* (2013.01); *C10G 11/00* (2013.01); *C10G 29/205* (2013.01); *C10G 47/00* (2013.01); *C10G 50/00* (2013.01); *C10G 69/00* (2013.01); *C10G 2300/1022* (2013.01); *C10G 2400/08* (2013.01)

(58) Field of Classification Search

CPC ..... C10G 11/00; C10G 2300/1022; C10G 2400/08; C10G 29/205; C10G 47/00; C10G 50/00; C10G 69/00; C10G 9/00; C10L 1/04

See application file for complete search history.

(56) References Cited

U.S. PATENT DOCUMENTS

| | | | | |
|---|---|---|---|---|
| 2,913,506 | A | 11/1959 | Engel et al. | |
| 3,661,801 | A | 5/1972 | Gutmann et al. | |
| 4,197,185 | A | 4/1980 | Le Page et al. | |
| 4,544,791 | A | 10/1985 | Juguin et al. | |
| 4,642,404 | A | 2/1987 | Shihabi | |
| 5,284,989 | A | 2/1994 | Apelian et al. | |
| 6,890,423 | B2 | 5/2005 | O'Rear | |
| 7,495,144 | B2 | 2/2009 | Elomari | |
| 7,678,954 | B2 | 3/2010 | Kuechler et al. | |
| 8,124,823 | B2 | 2/2012 | Hommeltoft et al. | |
| 2007/0225538 | A1 | 9/2007 | Elomari | |
| 2010/0108568 | A1* | 5/2010 | De Klerk | C10G 2/32 208/58 |
| 2011/0108568 | A1 | 5/2011 | Hogan | |
| 2012/0125814 | A1 | 5/2012 | Sanchez et al. | |

FOREIGN PATENT DOCUMENTS

| | | |
|---|---|---|
| CN | 1246888 | 3/2000 |
| CN | 1453338 | 11/2003 |
| EP | 0463673 A1 | 1/1992 |
| WO | 2008/124852 A2 | 10/2008 |

OTHER PUBLICATIONS

M. E. Dry et al. "Technology of the Fischer-Tropsch Process", Catal. Rev.-Sci. Eng., 23(1&2), pp. 265-278 (1981).
Philip A. Schweitzer, "Handbook of Separation Techniques for Chemical Engineers", Practical Design Approach, (1979).
Juan Carlos Serrano-Ruiz, "Catalytic Production of Liquid Hydrocarbon Transportation Fuels", XP-002715022, pp. 29-56 (2012).
M. E. Dry, "Sasol's Fischer-Tropsch experience", Hydrocarbon Processing, pp. 121-124 (Aug. 1982).
M. E. Dry, "FT catalysts", Studies in Surface Science and Catalysis, pp. 533-597 (2004).
Arno De Klerk, "Refining Technology Selection", Fischer-Tropsch Refining, 16, pp. 303-334 (2011).
Arno De Klerk, "Isomerization", Fischer-Tropsch Refining, 18, pp. 353-367 (2011).
Arno De Klerk, "Cracking", Fischer-Tropsch Refining, 21, pp. 407-440 (2011).
European Search Report of EP Application No. 13001989.6 dated Jan. 24, 2014.
European Search Report of EP Application No. 13001989.6 dated Nov. 4, 2013.

* cited by examiner

*Primary Examiner* — Sharon Pregler
(74) *Attorney, Agent, or Firm* — Roberts Mlotkowski Safran Cole & Calderon, P.C.

(57) ABSTRACT

A process for producing jet fuel comprising the following steps:

A.1) separating at least a portion of the $C_9$ to $C_{15}$ fraction from the product of a hydrocarbon synthesis process;

A.2) converting at least a part of the separated $C_9$ to $C_{15}$ fraction to aromatic hydrocarbons;

A.3) obtaining a jet fuel comprising the, optionally further treated, converted separated $C_9$ to $C_{15}$ fraction of step A.2);

B.1) separating at least a portion of the $C_{16+}$ fraction from the product of a hydrocarbon synthesis process;

B.2) reducing the average number of carbon atoms of at least a portion of the separated $C_{16+}$ fraction;

B.3) optionally, separating the $C_9$ to $C_{15}$ fraction of at least a portion from the product obtained from step B.2); and B.4) adding at least a portion of the $C_9$ to $C_{15}$ fraction separated in step B.3), if present; or at least a portion of the product of step B.2).

21 Claims, 5 Drawing Sheets

PROCESS FOR PRODUCING JET FUEL FROM A HYDROCARBON SYNTHESIS PRODUCT STREAM

The present invention relates to a process for producing jet fuel from the product of a hydrocarbon synthesis process, the product obtained from this process and the use thereof.

The current energy climate highlights three key aspects relevant in the development of any new process for the production of a synthetic jet fuel product:

- a product that is a fully fungible, on-specification jet fuel—allowing standalone jet fuel production in line with energy security considerations
- maximised yield of the targeted jet fuel product in order to amplify the commercial feasibility of such a process
- improved energy efficiency relative to previously suggested refining processes, hence facilitating an improved inherent carbon footprint for the process.

Jet fuel produced from non-petroleum sources, such as those derived via syngas from a hydrocarbon synthesis process, such as a Fischer Tropsch (FT) process, or from hydrogenated vegetable oil (HVO) are typically highly paraffinic and have excellent burning properties. Furthermore, they have a very low sulphur content. This makes them highly suitable as a fuel source where environmental concerns are important; and in circumstances where the security of supply and availability of petroleum supplies may cause concern.

However, although many physical properties for conventional jet fuel product can be matched and even outperformed using synthetic fuels, the fuels derived from synthetic processes cannot easily provide conventional jet fuel "drop-in compatibility" (i.e. be amenable to direct substitution within the conventional petroleum-derived jet fuel infrastructure), as they lack some of the major hydrocarbon constituents of typical petroleum-derived kerosene fuel. For example, due to their low aromatic content, FT jet fuels tend not to comply with certain industry jet fuel specified characteristics such as minimum density, seal swell propensity and lubricity.

The current art teaches various refining flow schemes for achieving appreciable yields of kerosene or jet fuel product derived from synthetic or non-petroleum sources, as well as methods of modifying the inherent chemistry of synthetic jet fuel in order to achieve a chemistry that is more compatible with crude-derived jet fuel.

WO 2008/124852 teaches a means of achieving a synthetic jet fuel through the use of multiple conversion processes carried out on the product of a Fischer-Tropsch process. The process of WO 2008/124852 includes:

- separating the product of the hydrocarbon synthesis process into a $C_{9+}$ fraction and $C_2$ to $C_8$ fraction;
- aromatization of the $C_2$ to $C_8$ fraction It teaches that achieving maximised jet fuel yield from a Low Temperature Fischer Tropsch process necessitates sending hydrocarbons heavier than $C_9$ through a hydrocracking process. This step results in the loss of kerosene-range material through cracking down to naphtha and hence in decreased efficiency in producing jet fuel. Furthermore, this can have particular impact on the carbon footprint of the process.

U.S. Pat. No. 6,890,423 teaches the production of a fully synthetic jet fuel produced from a Fisher-Tropsch feedstock. The seal swell and lubricity characteristics of the base Fischer-Tropsch distillate fuel are adjusted through the addition of alkylaromatics and alkylcycloparaffins that are produced via the catalytic reforming of FT naphtha ($C_8$ and lower) product. This process can result in a suitable on-specification jet fuel product generated entirely from a non-petroleum source, but the additional reforming and subsequent alkylation steps required to generate the alkylaromatics and alkylcycloparaffins in the jet fuel range impart additional cost, energy requirement and complexity to the process.

US 2012/0125814 describes a process for reforming a feed composed of one or more hydrocarbon cuts containing 9 to 22 carbon atoms.

Thus, there is the need for a less complex process for producing jet fuel from the product of a hydrocarbon synthesis process having an improved carbon footprint.

It has been found that the above problem can be solved by converting at least a part the $C_9$ to $C_{15}$ fraction from the product of a hydrocarbon synthesis process to aromatic hydrocarbons.

Therefore, the present invention provides a process for producing jet fuel comprising the following steps:

A.1) separating at least a portion of the $C_9$ to $C_{15}$ fraction from the product of a hydrocarbon synthesis process;

A.2) converting at least a part of the separated $C_9$ to $C_{15}$ fraction to aromatic hydrocarbons;

A.3) obtaining a jet fuel comprising the, optionally further treated, converted separated $C_9$ to $C_{15}$ fraction of step A.2);

B.1) separating at least a portion of the $C_{16+}$ fraction from the product of a hydrocarbon synthesis process;

B.2) reducing the average number of carbon atoms of at least a portion of the separated $C_{16+}$ fraction;

B.3) optionally, separating the $C_9$ to $C_{15}$ fraction of at least a portion from the product obtained from step B.2); and B.4) adding at least a portion of the $C_9$ to $C_{15}$ fraction separated in step B.3), if present; or at least a portion of the product of step B.2)

to the separated $C_9$ to $C_{15}$ fraction obtained from step A.1); and/or the product of one or more of the steps subsequent of step A.1) before step A.3) is effected, such as to the product obtained from step A.2) and/or to the product obtained from step A.1.1), if present, and/or to the separated $C_9$ to $C_{15}$ fraction obtained from step A.2.1), if present; and/or the steps subsequent of step A.1) before step A.3) is effected, such as step A.2) and/or step A.1.1), if present, and/or step A.2.1), if present; and/or step A.3).

It has been surprisingly found that a part of the $C_9$ to $C_{15}$ fraction from the product of a hydrocarbon synthesis process can be directly converted into aromatic compounds without the formation of coke and/or the cracking of the $C_9$ to $C_{15}$ fraction. As a result of the absence of coke formation, the catalyst efficiency is significantly improved. Furthermore, the obtained product meets all specification of a jet fuel. In addition by reducing the average number of carbon atoms of at least a portion of the separated $C_{16+}$ fraction and using the $C_9$ to $C_{15}$ fraction obtained therefrom as jet fuel (optionally further treated) the yield can be significantly improved.

A jet fuel usually contains at least 8 mass % aromatic compounds, has a freezing point of less than −49° C. and a density of 775 kg/m$^3$ or more.

In the present invention the following applies:

1 bar=0.1 MPa

A "fraction" denotes a part of the whole, whereby one fraction differs from the other fraction(s) in that at least one physical property is different, such as the boiling point.

Thus, for example the $C_9$ to $C_{15}$ fraction differs in its boiling point from the $C_{16+}$ fraction.

A "portion" denotes a part of the whole which is obtained by splitting the whole into two or more portions. Hence, two portions having the same origin do not differ from each other in their physical properties.

For example the $C_9$ to $C_{15}$ fraction may be split into two or more portions, whereby each portion does not differ in their physical properties from the other portion(s).

In case of an integrated plant it may be desirable not to feed the entire product of one process step to only one subsequent process step but the stream may be split and fed to two or more different process steps for the production of more than one product.

This is explained using the following non-limiting example. Step B.2 reads as follows.

B.2) reducing the average number of carbon atoms of at least a portion of the separated $C_{16+}$ fraction;

Thus, step B.2) covers the case wherein the whole $C_{16+}$ fraction obtained in step B.1) is used in step B.2) as well as the case wherein only a portion of the $C_{16+}$ fraction obtained in step B.1) is used in step B.2) and the remaining part of the $C_{16+}$ fraction obtained in step B.1) is used to produce different products.

In case of predominantly or only producing jet fuel it is of course desirable not to withdraw reactant streams or portions thereof which can be converted into jet fuel by subsequent steps.

Hence, preferably in each process step reciting "at least a portion" at least 90 mass % of the respective stream are used, more preferably at least 95 mass % of the respective stream are used, even more preferably at least 97 mass % of the respective stream are used and most preferably 100 mass % of the respective stream are used. In this context "stream" covers "fraction" and "product".

A supported catalyst is a catalyst wherein the catalytically active compounds are attached to a structure which is itself not, or only negligibly, catalytically active.

The $C_{1/2}$ fraction has a boiling point of below −55° C. at a pressure of 1 bar.

The $C_3$ to $C_8$ fraction has a boiling point of −55° C. to less than 138° C. at a pressure of 1 bar.

In the present invention the $C_{8-}$ fraction consists of the $C_{1/2}$ fraction and the $C_3$ to $C_8$ fraction, i.e. has a boiling point of less than 138° C. at a pressure of 1 bar.

The $C_9$ to $C_{15}$ fraction is the fraction boiling within the range of 138° C. to 279° C. at a pressure of 1 bar.

The $C_{16+}$ fraction is the fraction boiling above 279° C. at a pressure of 1 bar.

In step A.2) usually not the entire separated $C_9$ to $C_{15}$ fraction is converted into aromatic hydrocarbons. Although a complete conversion is possible, the conversion is usually not higher than 25 mass %. Therefore, step A.2) recites that "a part" is converted into aromatic hydrocarbons.

Preferably, step A.2) is effected by dehydrocyclisation. In a dehydrocyclisation process usually a linear aliphatic compound is converted into a cyclic aliphatic compound and, thereafter, the cyclic aliphatic compounds are aromatised by dehydrogenation. This process is also referred to as "heavy paraffin reforming" (HPR).

Step A.2) is preferably effected at a temperature of at least 300° C., more preferably of at least 350° C. and most preferably at a temperature of at least 400° C.

Preferably, step A.2) is effected at a temperature of not more than 600° C., more preferably of not more than 540° C. and most preferably at a temperature not more than 500° C.

Step A.2) is preferably effected at a pressure of at least 0.1 MPa, more preferably of at least 0.2 MPa and most preferably of at least 0.35 MPa.

Preferably step A.2) is effected at a pressure of not more than 2.5 MPa, more preferably of not more than 2.0 MPa and most preferably of not more than 1.5 MPa.

Usually, step A.2) is effected in the presence of a catalyst.

Preferably, in step A.2) a catalyst comprising one or more catalytically active metals selected from ruthenium, rhodium, palladium, silver, osmium, iridium, platinum, tin and gold, more preferably the catalyst is comprising one or more catalytically active metals selected from platinum, iridium and tin and most preferably one of the catalytically active metals is platinum. Usually, the catalyst does not comprise more than three catalytically active metals, preferably not more than two catalytically active metals.

Particularly preferred combinations of catalytically active metals are platinum/tin and platinum/iridium.

The total content of catalytically active metals in the catalyst is preferably at least 0.05 mass %, more preferably at least 0.15 mass % based on the total weight of the catalyst excluding the optional support.

The total content of catalytically active metals in the catalyst is preferably not more than 1.5 wt. %, more preferably not more than 0.5 mass % based on the total weight of the catalyst excluding the optional support.

In case platinum is present in the catalyst, the platinum content is preferably at least 0.05 mass %, more preferably at least 0.15 mass % based on the total weight of the catalyst excluding the optional support.

In case platinum is present in the catalyst, the platinum content is preferably not more than 1.0 wt. %, more preferably not more than 0.4 mass % based on the total weight of the catalyst excluding the optional support.

The catalyst may further comprise a promoter.

In the present invention a promoter is/are one or more elements which improve the reactivity of the catalytically active metal but itself does not or only negligible catalyse a reaction.

Besides the catalytically active metal(s) the catalyst preferably further comprises one or more additional promoters selected from Li, Na, K, Rb, Cs Be, Mg, Ca, Sr, Ba La, Ce, Pr, Nd, Sm, Eu, Gd, Tb, Dy, Ho, Er, Tm, Yb, Lu C, Si, Ge, Sn, Pb Sc, Y B, Al, Ga, In, TI N, P, As, Sb, Bi Mn, Re More preferably, the promoter(s) is/are selected from Si, Ge, Sn, In, P, Ga, Bi and Re and most preferably the promoter(s) is/are selected from Ge, In, P, Ga, Bi.

The catalyst may be used as such, e.g. in granular form, or supported by a support structure. The latter case is denoted as supported catalyst.

As already outlined above the support, as such, is usually not or only negligibly catalytically active.

Preferably in step A.2) a supported catalyst is used.

The support is preferably selected from refractory oxides and/or zeolites.

The catalyst preferably has a surface area of at least 50 $m^2/g$, more preferably at least 80 $m^2/g$.

Preferably, the catalyst has a surface area of not more than 300 $m^2/g$, more preferably of not more than 250 $m^2/g$.

Preferably, the recycle ratio in step A.2) is in the range from 1.5 to 7, preferably in the range from 2 to 6 and more preferably in the range from 3 to 5.

In the present invention "recycle ratio" is the ratio between the volume recycled and the volume feed to the reactor.

Preferably, the $C_9$ to $C_{15}$ fraction in step A.1) is separated from the product of a hydrocarbon synthesis process by distillation.

Such distillation processes are well-known in the art and, inter alia, described in Handbook of Separation Techniques for Chemical Engineers, Schweitzer, McGraw Hill 1979.

Preferably, the process further comprises the following step:

A.1.1) hydrotreating the portion of the $C_9$ to $C_{15}$ fraction separated in step A.1) before step A.2) is effected.

In a hydrotreatment step, hydrogen is employed to remove heteroatoms and selectively hydrogenate various functional groups. Typically, olefins will be hydrogenated to the corresponding saturated compound and groups containing (or consisting of) heteroatoms, such as sulphur, oxygen and nitrogen etc., will be removed,. Such hydrotreatment processes are well-known in the art and, inter alia, described in Chapter 16, Fischer Tropsch Refining, A de Klerk, Wiley-VCH, 2011.

In step A.2) some cracking of the $C_9$ to $C_{15}$ fraction may occur resulting in a small amount (usually less than 5 mass %) of a $C_{8-}$ fraction. Depending on the desired product specifications of the jet fuel, separation of said $C_{8-}$ fraction may be desired.

The process preferably, further comprises the following step:

A.2.1) separating the $C_9$ to $C_{15}$ fraction of at least a portion of the product obtained from step A.2) before step A.3) is effected.

Preferably, the $C_9$ to $C_{15}$ fraction in step A.2.1) is separated from the product obtained from step A.2) by distillation.

Such distillation processes are well-known in the art and, inter alia, described in Handbook of Separation Techniques for Chemical Engineers, Schweitzer, McGraw Hill 1979.

In case step A.2.1) is present, in addition to separating the $C_9$ to $C_{15}$ fraction of at least a portion of the product obtained from step A.2), the $C_{8-}$ fraction of said at least portion of the product obtained from step A.2) may be separated.

In case step A.2.1) is present and the $C_{8-}$ fraction is obtained in step A.2.1), the $C_{8-}$ fraction may be further divided into a $C_{1/2}$ fraction and $C_3$ to $C_8$ fraction. This can be made in an additional, subsequent step before step A.3) is effected but is preferably made in step A.2.1). These fractions may, for example, be used as fuel gas and liquefied petroleum gas (LPG), respectively. Alternatively, in case the $C_3$ to $C_8$ fraction is obtained in step A.2.1) or in an additional, subsequent step this $C_3$ to $C_8$ fraction may be used as described in the present invention (cf. below).

Usually, in step A.2) no or only a negligible amount of $C_{16+}$ fraction is produced which is usually not separated from the $C_9$ to $C_{15}$ fraction as such a $C_{16+}$ fraction usually does not negatively affect the suitability of the $C_9$ to $C_{15}$ fraction as jet fuel.

The $C_9$ to $C_{15}$ fraction obtained from step A.2.1), if present or step A.2) are suitable jet fuels.

In a hydrocarbon synthesis process it is usually not possible to selectively produce a $C_9$ to $C_{15}$ fraction. Hence, a $C_{16+}$ fraction and a $C_{8-}$ fraction is usually present in the product of a hydrocarbon synthesis process in addition to the $C_9$ to $C_{15}$ fraction.

The $C_{8-}$ fraction may be used as fuel. For this purpose the $C_{8-}$ fraction may be further divided into a $C_{1/2}$ fraction and $C_3$ to $C_8$ fraction. These fractions may, for example, be used as fuel gas, liquefied petroleum gas (LPG, $C_3/C_4$) and naphtha ($C_5$ to $C_8$), respectively.

However, in case this is not possible or desired the $C_{8-}$ fraction may be subjected to further process steps to increase the yield of jet fuel of the inventive process.

Preferably in step B.4) the at least a portion of the $C_9$ to $C_{15}$ fraction separated in step B.3), if present; or at least a portion of the product of step B.2)

is added to not more than three locations, more preferably is added to the product of step A.1) if step A.1.1) is not present or, to the product of step A.1.1) if step A.1.1) is present; and/or to the product obtained from step A.2) before step A.3) is effected, if steps A.2.1) is not present; or to the separated $C_9$ to $C_{15}$ fraction obtained from step A.2.1), if present, before step A.3) is effected; and/or to step A.2), even more preferably is added to the product obtained from step A.2) before step A.3) is effected, if steps A.2.1) is not present; or to the separated $C_9$ to $C_{15}$ fraction obtained from step A.2.1), if present, before step A.3) is effected; and/or to step A.2).

In case in step B.4) the at least a portion of the $C_9$ to $C_{15}$ fraction separated in step B.3), if present; or at least a portion of the product of step B.2)

is added to step A.2) the addition may be separately or together with the product of step A.1), if step A.1.1) is not present, or if step A.1.1) is present, together with the product of step A.1.1).

A reduction in the average number of carbon atoms per molecule is detected by monitoring the boiling point whereby a lower boiling point indicates a lower average number of carbon atoms per molecule.

Usually no pre-treatment, of the separated $C_{16+}$ fraction obtained from step B.1) is required before step B.2) is effected. Hence, preferably, no further step is present between steps B.1) and B.2). In other words, the separated $C_{16+}$ fraction obtained from step B.1) is subjected to step B.2).

Step B.2) may be effected by catalytic cracking, hydrocracking and/or thermal cracking, preferably step B.2) is effected by hydrocracking.

Suitable catalytic cracking, hydrocracking and thermal cracking steps are well-known in the art and, inter alia, described in Chapter 21, Fischer Tropsch Refining, A de Klerk, Wiley-VCH, 2011.

Suitable hydrocracking catalysts are at least one metal selected from Cr, Mo and W together with at least one metal selected from Fe, Ru and Os on an amorphous silica-alumina support (ASA) or Y-zeolite support;

at least one metal selected from Ru and Os on an amorphous silica-alumina support (ASA) or Y-zeolite support;

at least one metal selected from Ru and Os on a molecular sieve support (SAPO); or at least one metal selected from Pd and Pt on an amorphous silica-alumina support (ASA);

The conditions in step B.2) are usually selected to maximise the yield of the $C_9$ to $C_{15}$ fraction. Mild conditions with a high recycle rate are preferred in order to minimise excessive cracking of the $C_{16+}$ feed thereby minimizing the amount of $C_{8-}$ fraction. Such processes are described in Chapter 21, Fischer Tropsch Refining, A de Klerk, Wiley-VCH, 2011.

In case step B.2) is effected by hydrocracking, preferably, the temperature is within the range of 340 to 420° C.

Preferably, in case step B.2) is effected by hydrocracking, the pressure is within the range of 55 to 85 bar.

In case steps B.1)/B.2)/B.4) and, optionally B.3) are present, preferably the product of the hydrocarbon synthesis process steps A.1) and B.1) are effected on is the same, more preferably, steps A.1) and B.1) are effected simultaneously on the same product of a hydrocarbon synthesis process.

Preferably, the $C_{16+}$ fraction in step B.1), if present, is separated from the product of a hydrocarbon synthesis process by distillation, more preferably the separation steps A.1) and B.1) are effected by distillation, even more preferably, steps A.1) and B.1) are effected simultaneously by distillation of the same product of a hydrocarbon synthesis process.

In case step B.3) is present, the separation is preferably carried out by distillation.

Suitable distillation processes for steps B.1) and B.3) are well-known in the art and, inter alia, described in Handbook of Separation Techniques for Chemical Engineers, Schweitzer, McGraw Hill 1979.

The product obtained from step B.3), if present, or step B.2) may also be hydrosiomerised prior to step B.4). Thereby the freezing point of the final jet fuel can be further reduced if desired.

Thus, the process may comprise the following step:

B.3.1) hydroisomerising the product obtained from step B.3), if present, or step B.2), before step B.4) is effected.

Such a hydroisomerisation step is well-known in the art and, inter alia, described in Chapter 18, Fischer Tropsch Refining, A de Klerk, Wiley-VCH, 2011.

In case step B.3) is present, in addition to separating the $C_9$ to $C_{15}$ fraction of at least a portion of the product obtained from step B.2), the $C_{8-}$ fraction and/or the $C_{16+}$ fraction of said at least portion of the product obtained from step B.2) may be separated, preferably, the $C_{8-}$ fraction and the $C_{16+}$ fraction of said at least portion of the product obtained from step B.2) are separated.

In case step B.3) is present and the $C_{8-}$ fraction is obtained in step B.3), the $C_{8-}$ fraction may be further divided into a $C_{1/2}$ fraction and $C_3$ to $C_8$ fraction. This can be made in an additional, subsequent step but is preferably made in step B.3). These fractions may, for example, be used as fuel gas, liquefied petroleum gas (LPG) and naphtha, respectively. The $C_3$ to $C_8$ fraction may also be further used in the process according to the present invention as will be outlined below.

In case the $C_{16+}$ fraction is separated in step B.3), if present, the $C_{16+}$ fraction may be fed to further processes.

However, preferably, in case the $C_{16+}$ fraction is separated in step B.3), this $C_{16+}$ fraction is added to the $C_{16+}$ fraction separated in step B.1) before step B.2) is effected and/or is added to step B.2).

Thereby, the $C_{16+}$ fraction which remains after step B.2) is effected is recycled back to step B.2).

As already outlined above, after separating the $C_9$ to $C_{15}$ fraction in step A.1) and separating the $C_{16+}$ fraction in step B.1) the $C_{8-}$ fraction may for example, be used as fuel gas, liquefied petroleum gas (LPG) and naphtha. However, as also outlined above, in case this is not possible or desired the $C_{8-}$ fraction may be subjected to further process steps to provide additional jet fuel. Usually, the $C_{8-}$ fraction is further divided into a $C_{1/2}$ fraction and a $C_3$ to $C_8$ fraction therefore.

The process preferably further comprises the following steps:

C.1) separating at least a portion of the $C_3$ to $C_8$ fraction from the product of a hydrocarbon synthesis process;

C.2) increasing the average number of carbon atoms per molecule of at least a portion of the separated $C_3$ to $C_8$ fraction;

C.3) optionally, separating at least a portion of the $C_9$ to $C_{15}$ fraction of at least a portion from the product obtained from step C.2); and C.4) adding at least a portion of the $C_9$ to $C_{15}$ separated in step C.3), if present; or at least a portion of the product of step C.2)

to the separated $C_9$ to $C_{15}$ fraction obtained from step A.1); and/or the product of one or more of the steps subsequent of step A.1) before step A.3) is effected, such as to the product obtained from step A.2) and/or to the product obtained from step A.1.1), if present, and/or to the separated $C_9$ to $C_{15}$ fraction obtained from step A.2.1), if present; and/or the steps subsequent of step A.1), such as step A.2) and/or step A.1.1), if present, and/or step A.2.1), if present; and/or to step B.2).

Preferably in step C.4) the at least a portion of the $C_9$ to $C_{15}$ separated in step C.3), if present; or at least a portion of the product of step C.2)

is added to not more than three locations, more preferably is added to the product of step A.1) if step A.1.1) is not present or, to the product of step A.1.1) if step A.1.1) is present; and/or to the product obtained from step A.2) before step A.3) is effected, if steps A.2.1) is not present; or to the separated $C_9$ to $C_{15}$ fraction obtained from step A.2.1), if present before step A.3) is effected; or and/or to step A.2), and/or to step B.2), even more preferably is added to the product obtained from step A.2) before step A.3) is effected, if steps A.2.1) is not present; or to the separated $C_9$ to $C_{15}$ fraction obtained from step A.2.1), if present, before step A.3) is effected;

and/or to step A.2), and/or to step B.2)

and most preferably is added to to the product obtained from step A.2) before step A.3) is effected, if steps A.2.1) is not present; or to the separated $C_9$ to $C_{15}$ fraction obtained from step A.2.1), if present, before step A.3) is effected.

In case in step C.4) addition to step B.2) is made, preferably, at least a portion of the product of step C.2) is added to step B.2).

An increase in the average number of carbon atoms per molecule is detected by monitoring the boiling point whereby a higher boiling point indicates a higher average number of carbon atoms per molecule.

Step C.2) may be effected by a catalytic process, such as olefin oligomerisation and/or heavy aliphatic alkylation, preferably is effected by olefin oligomerisation.

The process preferably further comprises the following step:

C.1.1) dehydrogenation of the $C_3$ to $C_8$ fraction separated in step C.1) before step C.2) is effected.

Suitable olefin oligomerisation, heavy aliphatic alkylation and dehydrogenating steps are well-known in the art and, inter alia, described in U.S. Pat. No. 7,495,144 (heavy aliphatic alkylation).

In U.S. Pat. Nos. 2,913,506 and 3,661,801 (solid phosphorous acid catalysts), U.S. Pat. Nos. 4,197,185, 4,544,791 and EP 0.463.673 (ASA), U.S. Pat. Nos. 4,642,404 and 5,284,989 (zeolithe) are described for olefins oligomerisation.

In case step C.2) is effected by olefin oligomerisation, preferably the catalyst is selected from solid phosphoric acid (SPA) catalysts, amorphous silica-alumina (ASA) catalysts such as AXENS IP-811, resins catalysts such as AXENS TA-801 or zeolitic catalysts, preferably an amorphous silica-alumina (ASA) catalysts or zeolitic catalysts is used, more preferably an amorphous silica-alumina (ASA) catalyst is used.

The olefin oligomerisation, if present is preferably carried out at a temperature of 50° C. to 450° C. more preferably at 150° C. to 350° C.

Preferably, the olefin oligomerisation is carried out at a pressure of 15 bar to 80 bar, more preferably at 35 bar to 60 bar.

In case step C.1) is present, preferably the product of a hydrocarbon synthesis process steps A.1) and C.1) are effected on is the same, more preferably, steps C.1) and A.1) are effected simultaneously on the product of the hydrocarbon synthesis process.

In case step C.1) is present, preferably the product of the hydrocarbon synthesis process steps A.1), B.1) and C.1) are effected on is the same, more preferably, steps A.1), B.1) and C.1) are effected simultaneously on the product of the hydrocarbon synthesis process.

Preferably, the $C_3$ to $C_8$ fraction in step C.1), if present, is separated from the product of a hydrocarbon synthesis process by distillation, more preferably the separation steps A.1) and C.1) are separated by distillation, even more preferably, steps A.1) and C.1) are effected simultaneously by distillation of the same product of a hydrocarbon synthesis process, and most preferably steps A.1), B.1) and C.1) are effected simultaneously by distillation of the same product of a hydrocarbon synthesis process.

Suitable distillation processes for steps C.1) and C.3) are well-known in the art and, inter alia, described in Handbook of Separation Techniques for Chemical Engineers, Schweitzer, McGraw Hill 1979.

The product obtained from step C.3), if present, or step C.2) may also be hydroisomerised prior to step C.4). Thus, the process may comprise the following step:

C.3.1) hydroisomerising the product obtained from step C.3), if present, or step C.2) before step C.4) is effected.

Such a hydroisomerisation step is well-known in the art and, inter alia, described in Chapter 18, Fischer Tropsch Refining, A de Klerk, Wiley-VCH, 2011.

In case step C.3) is present the product obtained from step C.3) is preferably hydrogenated prior to step C.4).

Thus, in case step C.3) is present, the process may further comprise the following step:

C.3.2) hydrogenating and/or hydrotreating of the $C_9$ to $C_{15}$ fraction obtained from step C.3) before step C.4) is effected.

By step C.3.2), if present, olefins possibly present in the product obtained from step is performed to hydrogenate olefins.

Step C.3.2) is preferably present in case step C.2) is effected by olefin oligomerisation.

In case step C.3.2) is present, preferably, step C.3.1) is absent.

In case step C.3.1) is present, preferably, step C.3.2) is absent.

In case step C.3) is present, in addition to separating the $C_9$ to $C_{15}$ fraction of at least a portion of the product obtained from step C.2), the $C_{8-}$ fraction and/or the $C_{16+}$ fraction of said at least portion of the product obtained from step C.2) may be separated, preferably, the $C_{8-}$ fraction and the $C_{16+}$ fraction of said at least portion of the product obtained from step C.2) are separated.

In case step C.3) is present and the $C_{8-}$ fraction is obtained in step C.3), the $C_{8-}$ fraction may be further divided into a $C_{1/2}$ fraction and $C_3$ to $C_8$ fraction. This can be made in an additional, subsequent step but is preferably made in step C.3). These fractions may, for example, be used as fuel gas and liquefied petroleum gas (LPG) and naphtha, respectively. Alternatively and preferably:

a portion of the $C_3$ to $C_8$ fraction obtained in step C.3), if present, or an additional step subsequent of step C.3), if present, or at least a portion from the product obtained from step C.2);

is added to the $C_3$ to $C_8$ fraction separated in step C.1) before step C.2) is effected and/or is added to step C.2), more preferably, the $C_3$ to $C_8$ fraction obtained in step C.3), if present, or an additional step subsequent of step C.3), such as C.3.1) or C.3.2), if present, is dehydrogenated prior to being added to the $C_3$ to $C_8$ fraction separated in step C.1) before step C.2) is effected and/or is added to step C.2).

In case step C.3) is present and the $C_{16+}$ fraction is separated in step C.3), the $C_{16+}$ fraction may be fed to further processes.

However, preferably, in case the $C_{16+}$ fraction is separated in step C.3), this $C_{16+}$ fraction is added to the $C_{16+}$ fraction separated in step B.1) before step B.2) is effected and/or is added to step B.2).

Thereby, the $C_{16+}$ fraction which is produced in step C.2) as by-product is recycled.

In case step B.3) is present and the $C_3$ to $C_8$ fraction is obtained in step B.3) or a $C_{8-}$ fraction is obtained in step B.3) whereof the $C_3$ to $C_8$ fraction is separated in an additional, subsequent step, the $C_3$ to $C_8$ fraction obtained in step B.3) or in an additional step subsequent of step B.3) is preferably added to the $C_3$ to $C_8$ fraction separated in step C.1) before step C.2) is effected and/or is added to step C.2), more preferably, the $C_3$ to $C_8$ fraction obtained in step B.3) or in an additional step subsequent of step B.3) is dehydrogenated prior to being added to the $C_3$ to $C_8$ fraction separated in step C.1) before step C.2) is effected and/or is added to step C.2).

In case step A.2.1) is present and the $C_3$ to $C_8$ fraction is obtained in step A.2.1) or a $C_{8-}$ fraction is obtained in step A.2.1) whereof the $C_3$ to $C_8$ fraction is separated in an additional, subsequent step before step A.3) is effected, the $C_3$ to $C_8$ fraction obtained in step A.2.1) or in an additional step subsequent of step A.2.1) is preferably added to the $C_3$ to $C_8$ fraction separated in step C.1) before step C.2) is effected and/or is added to step C.2), more preferably, the $C_3$ to $C_8$ fraction obtained in step A.2.1) or in an additional step subsequent of step A.2.1) is dehydrogenated prior to being added to the $C_3$ to $C_8$ fraction separated in step C.1) before step C.2) is effected and/or is added to step C.2).

As outlined above, the the $C_3$ to $C_8$ fraction obtained in step C.3), if present, or an additional step subsequent of step C.3), if present, maybe dehydrogenated prior to being added to the $C_3$ to $C_8$ fraction separated in step C.1) before step C.2) is effected and/or is added to step C.2)

the $C_3$ to $C_8$ fraction obtained in step B.3), if present or in an additional step subsequent of step B.3), if present, maybe dehydrogenated prior to being added to the $C_3$ to $C_8$ fraction separated in step C.1) before step C.2) is effected and/or is added to step C.2); and/or the $C_3$ to $C_8$ fraction obtained in step A.2.1), if present, or in an additional step subsequent of step A.2.1), if present, maybe dehydrogenated prior to being added to the $C_3$ to $C_8$ fraction separated in step C.1) before step C.2) is effected and/or is added to step C.2), preferably, the $C_3$ to $C_8$ fraction obtained in step C.3), if present, or an additional step subsequent of step C.3), if present, is dehydrogenated prior to being added to the $C_3$ to $C_8$ fraction separated in step C.1) before step C.2) is effected and/or is added to step C.2)

the $C_3$ to $C_8$ fraction obtained in step B.3), if present or in an additional step subsequent of step B.3), if present, is dehydrogenated prior to being added to the $C_3$ to $C_8$ fraction separated in step C.1) before step C.2) is effected and/or is added to step C.2); and the $C_3$ to $C_8$ fraction obtained in step A.2.1), if present, or in an additional step subsequent of step A.2.1), if present, is dehydrogenated prior to being added to the $C_3$ to $C_8$ fraction separated in step C.1) before step C.2) is effected and/or is added to step C.2)

more preferably, the $C_3$ to $C_8$ fraction is obtained in step C.3), or an additional step subsequent of step C.3);

the $C_3$ to $C_8$ fraction is obtained in step B.3), or in an additional step subsequent of step B.3);

and the $C_3$ to $C_8$ fraction is obtained in step A.2.1), or in an additional step subsequent of step A.2.1);

and the $C_3$ to $C_8$ fraction obtained in step C.3), or an additional step subsequent of step C.3);

the $C_3$ to $C_8$ fraction obtained in step B.3), or in an additional step subsequent of step B.3);

and the $C_3$ to $C_8$ fraction obtained in step A.2.1), or in an additional step subsequent of step A.2.1);

is dehydrogenated prior to being added to the $C_3$ to $C_8$ fraction separated in step C.1) before step C.2) is effected and/or is added to step C.2) In case two or all of the the $C_3$ to $C_8$ fraction obtained in step C.3), if present, or an additional step subsequent of step C.3), if present, the $C_3$ to $C_8$ fraction obtained in step B.3) or in an additional step subsequent of step B.3), if present; and the $C_3$ to $C_8$ fraction obtained in step A.2.1) or in an additional step subsequent of step A.2.1)

are dehydrogenated prior to being added to the $C_3$ to $C_8$ fraction separated in step C.1) before step C.2) is effected and/or being added to step C.2), the the $C_3$ to $C_8$ fraction obtained in step C.3), if present, or an additional step subsequent of step C.3), if present, the $C_3$ to $C_8$ fraction obtained in step B.3) or in an additional step subsequent of step B.3), if present; and the $C_3$ to $C_8$ fraction obtained in step A.2.1) or in an additional step subsequent of step A.2.1)

are combined prior to dehydrogenation.

In case one or more streams as outlined above are dehydrogenated, they may be combined with the at least portion of the $C_3$ to $C_8$ fraction separated in step C.1) before step C.1.1) is effected or may be fed to step C.1.1).

In case step A.2.1) is present and the $C_{16+}$ fraction is obtained in step A.2.1), said $C_{16+}$ fraction is preferably added to the $C_{16+}$ fraction separated in step B.1) before step B.2) is effected and/or is added to step B.2).

Hydrocarbon synthesis processes producing a suitable product to be used in the process of the present invention are known in the art. Preferably, the hydrocarbon synthesis process is a Fischer-Tropsch process, more preferably a Low Temperature Fischer-Tropsch (LTFT) process.

The LTFT process is a well known process in which carbon monoxide and hydrogen are reacted over an iron, cobalt, nickel or ruthenium containing catalyst to produce a mixture of straight and branched chain hydrocarbon products ranging from methane to waxes and smaller amounts of oxygenates. This hydrocarbon synthesis process is based on the Fischer-Tropsch reaction:

$$2H_2+CO \rightarrow \sim[CH_2]\sim+H_2O$$

where $\sim[CH_2]\sim$ is the basic building block of the hydrocarbon product molecules.

The LTFT process is therefore used industrially to convert synthesis gas (which may be derived from coal, natural gas, biomass or heavy oil streams) into hydrocarbons ranging from methane to species with molecular masses above 1400. Whilst the main products are typically linear paraffinic species, other species such as branched paraffins, olefins and oxygenated components may form part of the product slate. The exact product slate depends on the reactor configuration, operating conditions and the catalyst that is employed. For example this has been described in the article *Catal. Rev.-Sci. Eng.*, 23 (1&2), 265-278 (1981) or *Hydroc. Proc.* 8, 121-124 (1982), which is included by reference.

Preferred reactors for the hydrocarbon synthesis process are slurry bed or tubular fixed bed reactors.

The hydrocarbon synthesis process is preferably carried out at a temperature of at least 160° C., more preferably at least 210° C.

Preferably the hydrocarbon synthesis process is carried out at a temperature of 280° C. or less, more preferably 260° C. or less.

The hydrocarbon synthesis process is preferably carried out at a pressure of at least 18 bar, more preferably of at least 20 bar.

Preferably the hydrocarbon synthesis process is carried out at a pressure of 50 bar or less, more preferably 30 bar or less.

The hydrocarbon synthesis catalyst may comprise active metals such as iron, cobalt, nickel or ruthenium. Suitable catalysts are described in Chapter 7, Fischer Tropsch Technology, Steynberg et al, Elsevier 2004.

By the inventive process and its preferred embodiments outlined above, the whole product of a hydrocarbon synthesis process can be converted into jet fuel. The overall yield of jet fuel obtainable based on the product of the hydrocarbon synthesis process is usually above 60 mass %. The process may be operated such that the major by-product formed is the $C_{1/2}$ fraction which may be used as fuel gas.

Thus, the process can be carried out in an isolated plant. This allows that the plant can be located where desired, for example directly at the location where the feed stream for the hydrogen synthesis process is obtained, such as oil-/gas-fields or coal mines.

However, the process may also be carried out as one of several different processes in an integrated plant where the different fractions of a hydrocarbon synthesis process are used for the production of different products.

In such a case it may be desirable to only use the $C_9$ to $C_{15}$ fraction of the product of a hydrocarbon synthesis process for the production of jet fuel and the $C_{8-}$ and $C_{16+}$ fractions for different purposes, e.g. as outlined above. Of course, also in an integrated plant, the $C_{8-}$ and/or $C_{16+}$ fraction(s) may fully or in part be used to produce jet fuel as outlined above.

Especially in an integrated plant it may also be desirable to only use a portion of the $C_9$ to $C_{15}$ fraction for the production of jet fuels and the remaining portion(s) for the production of different products.

Therefore, the wording "at least a portion" is used to cover all of the above situations.

The present invention is furthermore directed to a product obtainable by the process according to the invention.

The present invention is also directed to the use of at least a portion of the $C_9$ to $C_{15}$ fraction from the product stream of a hydrocarbon synthesis process wherein a part of the fraction has been converted to aromatic hydrocarbons together with at least a portion of the $C_{16+}$ fraction from the product of a hydrocarbon synthesis process wherein of at least a portion of the $C_{16+}$ fraction the average number of carbon atoms has been reduced, as jet fuel.

FIG. 1 describes the general process of the present invention.

Figure 1:
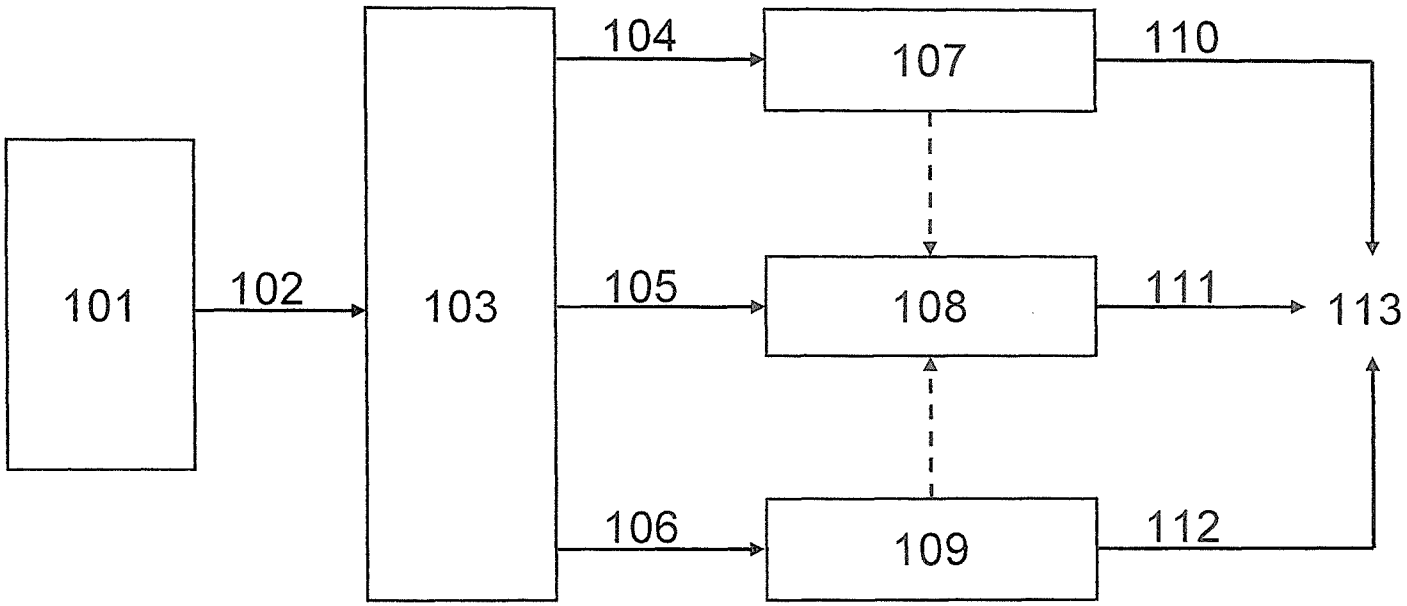

In FIG. 1 the product of a hydrocarbon synthesis process (101), such as an LTFT process is routed to fractionation column (103) via conduit (102) and fractionated in fractionation column (103) into a $C_{8-}$ fraction withdrawn through a first conduit (104), a $C_9$ to $C_{15}$ fraction withdrawn through a second conduit (105) and a $C_{16+}$ fraction withdrawn through a third conduit conduit (106).

The $C_{8-}$ fraction may be used as fuel gas and liquefied petroleum gas (LPG) and naphtha or as shown in FIG. 1 the average number of carbon atoms per molecule may be increased (107), e.g. by olefin oligomerisation or heavy aliphatic alkylation.

The $C_9$ to $C_{15}$ fraction is subjected to an aromatisation step (108), e.g. heavy paraffin reforming wherein a part of the $C_9$ to $C_{15}$ fraction is converted into aromatic hydrocarbons.

The average number of carbon atoms of the $C_{16+}$ fraction is reduced (109), e.g. by hydrocracking, thermal cracking or catalytic cracking.

The streams (111) and (112) obtained from aromatisation step (108) and the step wherein the average number of carbon atoms of the $C_{16+}$ fraction is reduced (109), respectively are combined and used as jet fuels.

In case the $C_{8-}$ fraction is subjected to a step wherein the average number of carbon atoms per molecule is increased (107) the stream obtained therefrom through conduit (110) is combined with the streams (111) and (112) obtained from aromatisation step (108) and the step wherein the average number of carbon atoms of the $C_{16+}$ fraction is reduced (109) and used as jet fuel.

Optionally, in the step wherein the average number of carbon atoms per molecule is increased (107) and the step wherein the average number of carbon atoms of the $C_{16+}$ fraction is reduced (109) the $C_9$ to $C_{15}$ fraction obtained after the respective steps are separated and routed to the aromatisation step (108). This is shown by the dotted lines in FIG. 1.

Figure 2:
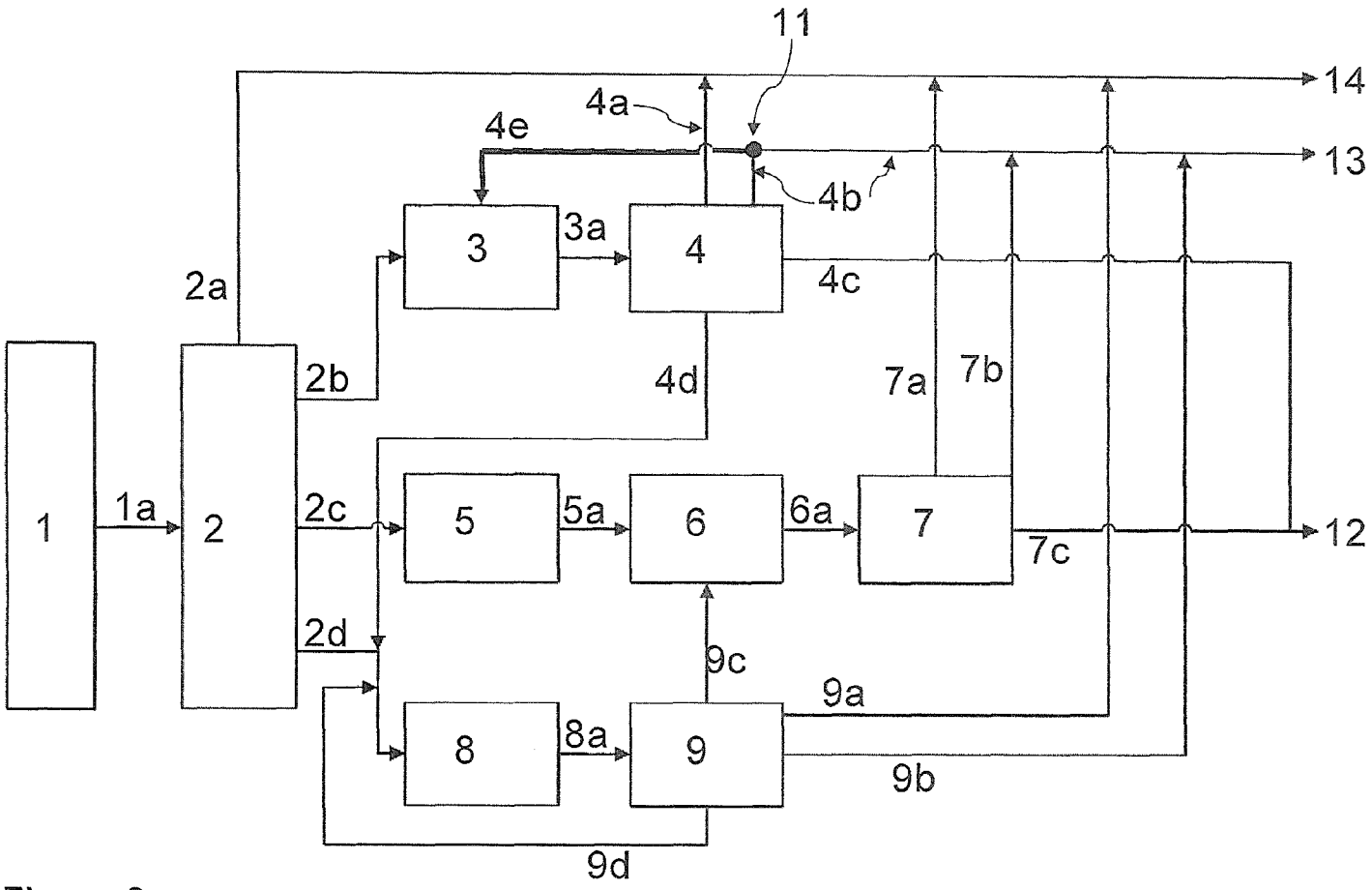
FIG. 2 shows a process according to the invention.

In FIG. 2 the product of a hydrocarbon synthesis process (1), such as an LTFT process is conveyed through conduit (1*a*) to a fractionation step (2) wherein the product of a hydrocarbon synthesis process is fractionated into a $C_{1/2}$ fraction, a $C_3$ to $C_8$ fraction, a $C_9$ to $C_{15}$ fraction and a $C_{16+}$ fraction. The $C_{1/2}$ fraction is conveyed through a conduit (2*a*) and used as fuel gas (14).

The $C_3$ to $C_8$ fraction is conveyed to an olefin oligomerisation or heavy aliphatic alkylation step (3) through conduit (2*b*). After the olefin oligomerisation or heavy aliphatic alkylation step (3) is effected the obtained product is conveyed to a fractionation step (4) and fractionated into a $C_{1/2}$ fraction, a $C_3$ to $C_8$ fraction, a $C_9$ to $C_{15}$ fraction and a $C_{16+}$ fraction. In case a $C_{1/2}$ fraction is produced in step (3), the $C_{1/2}$ fraction is withdrawn through a conduit (4*a*) from the fractionation step (4), combined with the $C_{1/2}$ fraction obtained from the fractionation step (2) and used as fuel gas (14).

The $C_3$ to $C_8$ fraction is withdrawn from the fractionation step (4) through conduit (4*b*) and used as LPG an naphtha (13). Conduit (4*b*) may contain a junction (11) wherein a portion or all of the $C_3$ to $C_8$ fraction obtained from fractionation step (4) is branched of to conduit (4*e*) and rerouted to the olefin oligomerisation or heavy aliphatic alkylation step (3).

The $C_9$ to $C_{15}$ fraction is withdrawn through conduit (4*c*) and used as jet fuel (12).

The $C_{16+}$ fraction is withdrawn through conduit (4*d*) and combined with the $C_{16+}$ fraction obtained from fractionation step (2) through conduit (2*d*).

The $C_9$ to $C_{15}$ fraction obtained from fractionation step (2) through conduit (2*c*) is conveyed to a hydrotreating step (5). The product of hydrotreating step 5 is conveyed through conduit (5*a*) to heavy paraffin reforming step (6) and the product obtained from heavy paraffin reforming step (6) is conveyed to a fractionation step (7) and fractionated into a $C_{1/2}$ fraction, a $C_3$ to $C_8$ fraction, a $C_9$ to $C_{15}$ fraction and a $C_{16+}$ fraction. The $C_{1/2}$ fraction is withdrawn through a conduit (7*a*) from the fractionation step (7), combined with the $C_{1/2}$ fraction obtained from the fractionation steps (2) and, optionally, (4) and used as fuel gas (14). The $C_3$ to $C_8$ fraction is withdrawn through line (7*b*) and used as LPG and naphtha (13).

The $C_9$ to $C_{15}$ fraction obtained in conduit (7*c*) is combined with the $C_9$ to $C_{15}$ fraction is obtained in conduit (4*c*) and used as jet fuel (12).

The $C_{16+}$ fraction obtained in conduits (2*d*) and (4*d*) is subjected to a hydrocracking step (8) and the obtained product is fractionated in fractionation step (9) into a $C_{1/2}$ fraction, a $C_3$ to $C_8$ fraction, a $C_9$ to $C_{15}$ fraction and a $C_{16+}$ fraction. The $C_{1/2}$ fraction is withdrawn through a conduit (9*a*) from the fractionation step (9), combined with the $C_{1/2}$ fraction obtained from the fractionation steps (2), (7) and, optionally, (4) and used as fuel gas (14). The $C_3$ to $C_8$ fraction is withdrawn through line (9*b*) and used as LPG and naphtha (13).

The $C_9$ to $C_{15}$ fraction is obtained in conduit (9*c*) and conveyed to heavy paraffin reforming step (6).

The $C_{16+}$ fraction obtained from fractionation step (9) is combined with the $C_{16+}$ fraction obtained from fractionation steps (2) and (4) and re-introduced into hydrocracking step (8).

The $C_3$ to $C_8$ fraction obtained in conduits (7*b*) and (9*b*) fractionation steps (7) and (9), respectively may also be combined with the $C_3$ to $C_8$ fraction obtained in conduit (4*b*) prior to junction (11). In such a case the only products obtained from the process are jet fuel (12) and a $C_{1/2}$ fraction (14).

Figure 3:
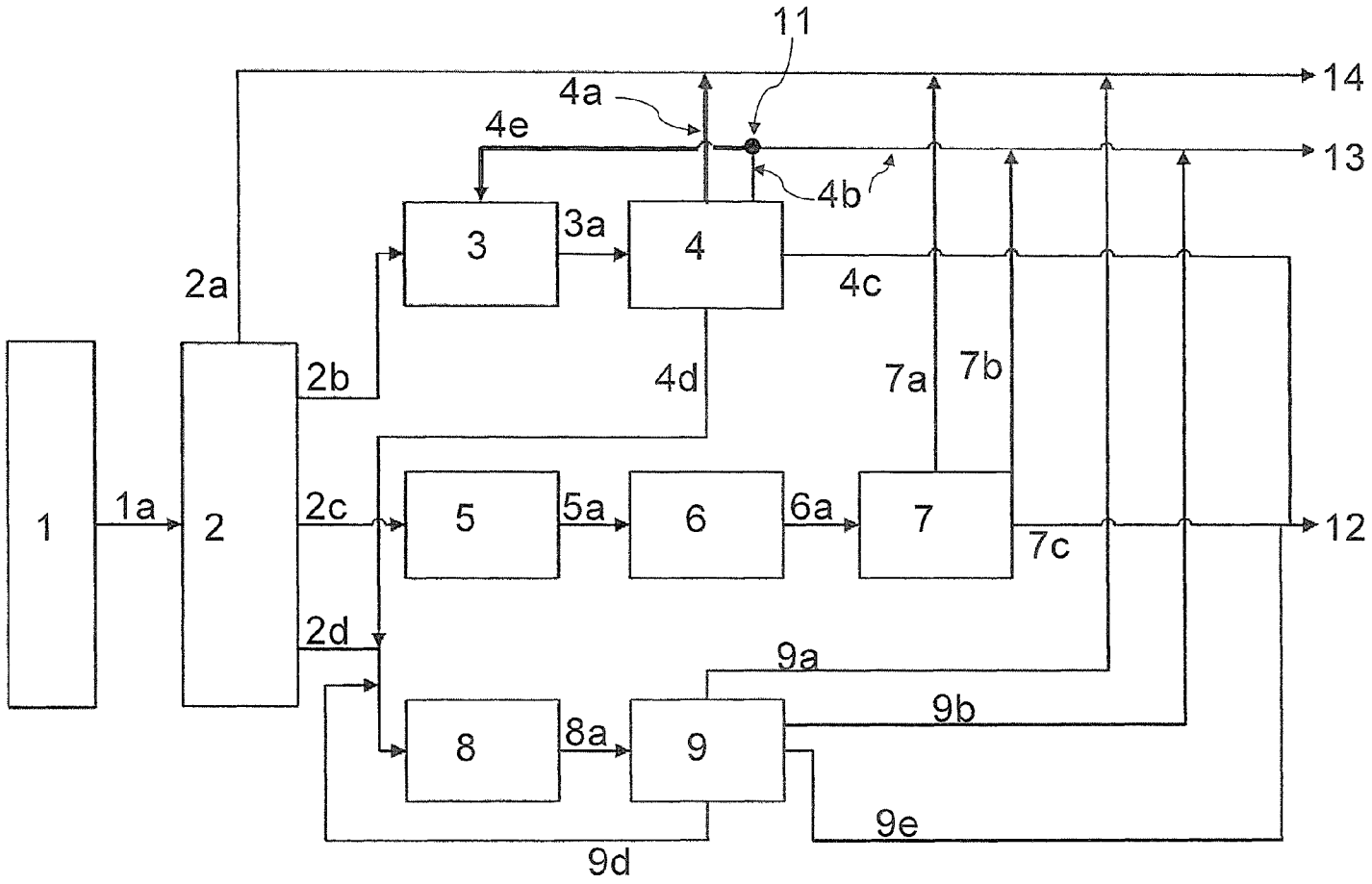
FIG. 3 shows a modification of the process of FIG. 2.

The process shown in FIG. 3 differs from the process of FIG. 2 in that the $C_9$ to $C_{15}$ fraction obtained in fractionation step (9) is not routed to the heavy paraffin reforming step (6) but obtained in conduit (9*e*) and used as jet fuel (12).

Figure 4:
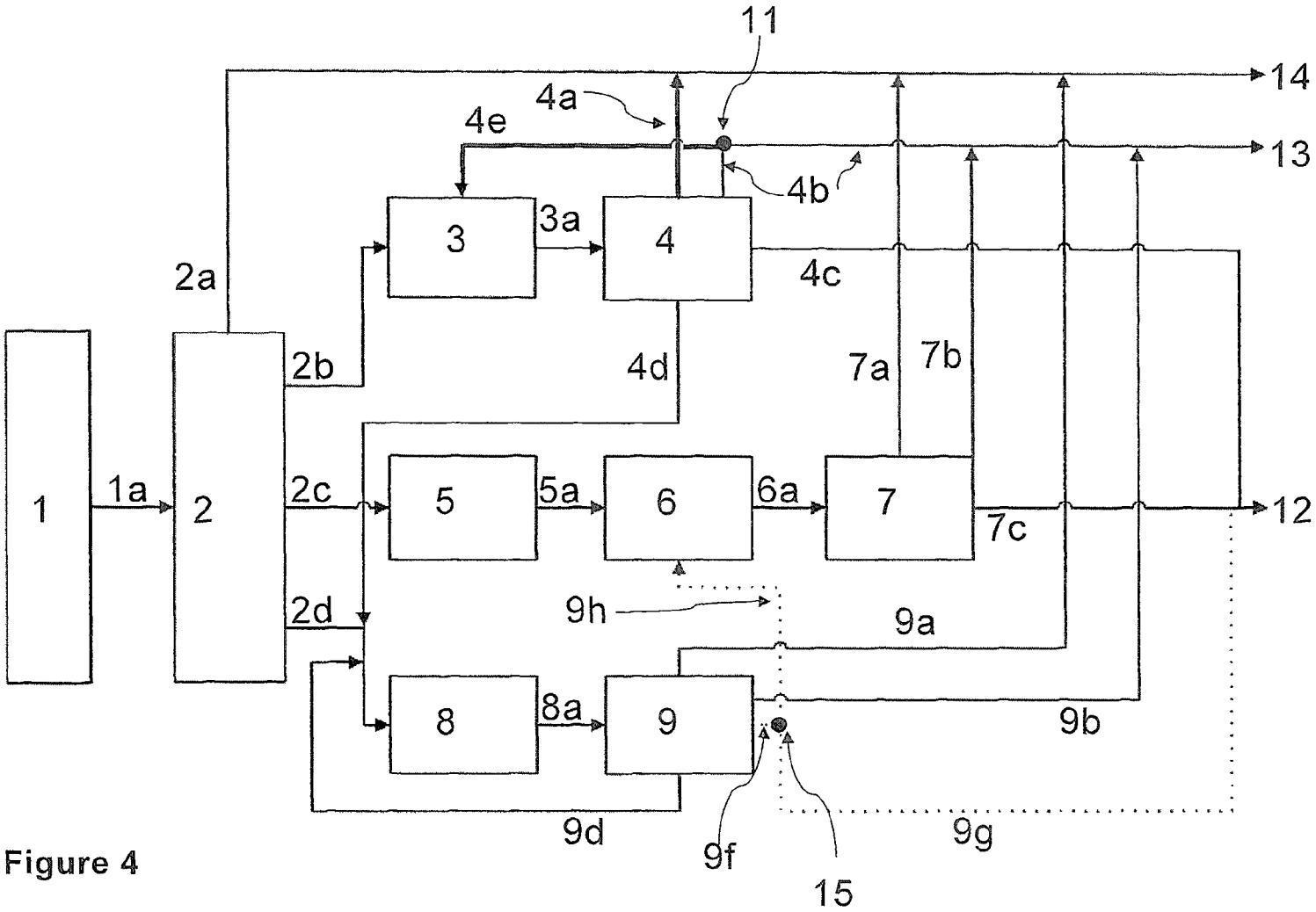
FIG. 4 shows a modification of the process of FIG. 3.

The process shown in FIG. 4 differs from the process of FIGS. 2 and 3 in that the $C_9$ to $C_{15}$ fraction obtained in fractionation step (9) is obtained in conduit (9*f*) split at junction (15) and a portion conveyed through conduit (9*h*) to heavy paraffin reforming step (6) and the other portion is obtained in conduit (9*g*) and used as jet fuel (12).

Figure 5:
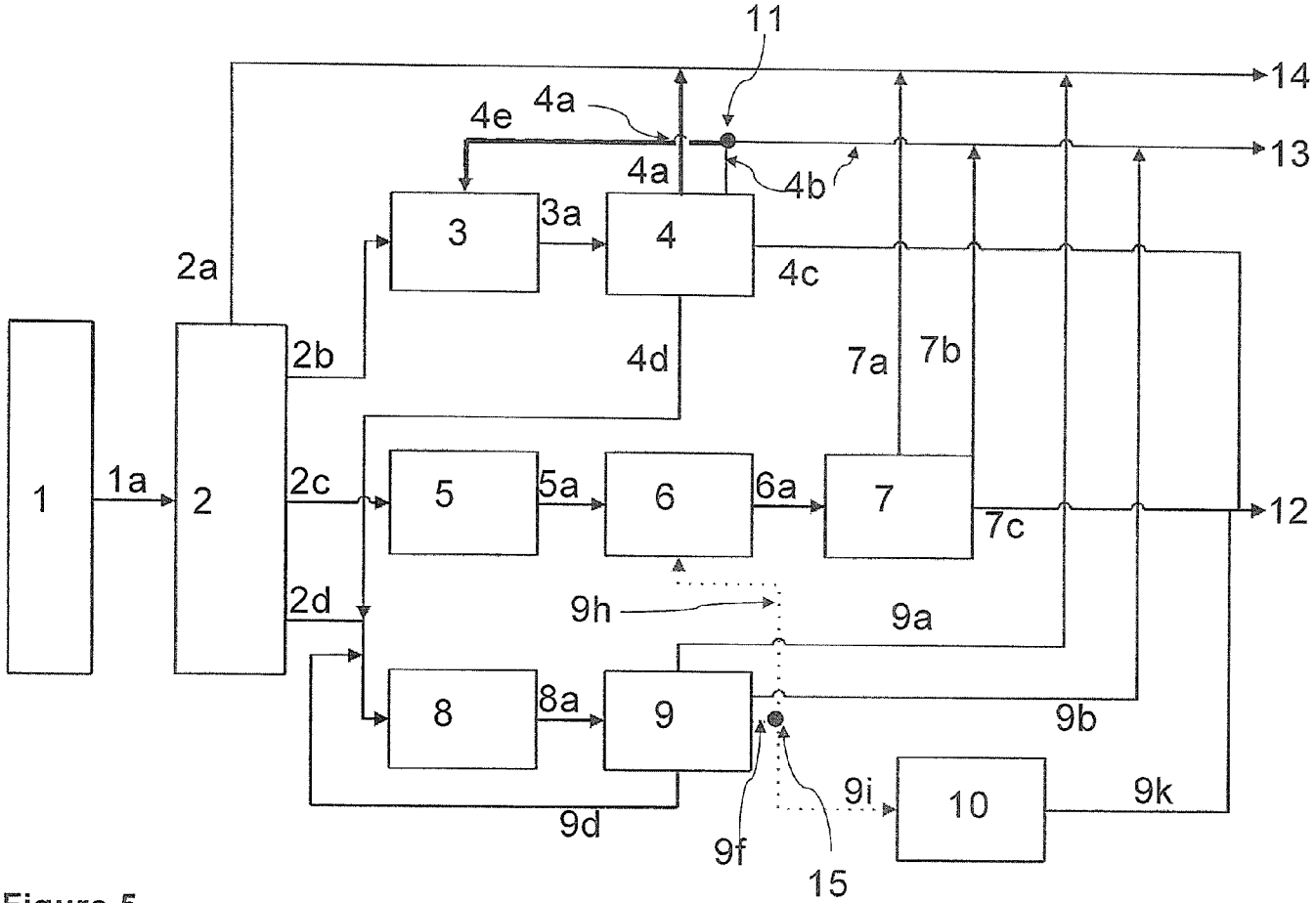
FIG. 5 shows a a modification of the process of FIG. 4.

The process shown in FIG. 5 differs from the process of FIG. 4 in that the $C_9$ to $C_{15}$ fraction obtained in fractionation step (9) is obtained in conduit (9*f*) split at junction (15) and a portion conveyed through conduit (9*h*) to heavy paraffin reforming step (6) and the other portion is obtained in conduit (9*i*) routed to hydroisomerisation step (10) and conveyed through conduit (9*k*) and used as jet fuel (12).

All documents cited within this application are herewith incorporated by reference.

The invention is now described by the following non-limiting examples.

EXAMPLE 1

The jet fuel refinery flow scheme in this example is illustrated in FIG. 2. The aim of this example is to illustrate the yield of final jet fuel product that can be produced from an LTFT syncrude feedstream using a simple form of the present invention.

The LTFT syncrude stream (1*a*) originating from the LTFT process (1) is routed through a fractionation step (2) to produce:

- the $C_{1/2}$ fraction (2*a*) that is routed to a fuel gas stream
- the $C_3$ to $C_8$ fraction (2*b*) that is fed to an oligomerisation unit (3)
- the $C_9$ to $C_{15}$ fraction (2*c*) that is fed to a hydrotreater unit (5) and then used as the feedstream for an heavy paraffin reforming unit (6)
- the $C_{16+}$ fraction (2*d*) that is fed to the hydrocracker unit (8).

The oligomerisation unit (3) is operated in accordance with the description of this invention utilising an ASA catalyst under temperature conditions of 220 to 290° C. and pressure conditions of approximately 65 bar. The product stream (3*a*) is then routed to a second fractionator (4), where:

- no $C_{1/2}$ fraction (4*a*) is produced in step (3) and, thus, no $C_{1/2}$ fraction is obtained in step (4);
- A portion of the $C_3$ to $C_8$ fraction is conveyed through conduit (4*b*) to a fuel stream;
- A portion of the $C_3$ to $C_8$ fraction is conveyed through conduit (4*e*) to the olefin oligomerisation unit (3);
- the $C_9$ to $C_{15}$ fraction (4*c*) is routed to the final jet fuel product
- the $C_{16+}$ fraction (4*d*) is used as feed stream for the hydrocracker unit (8).

The kerosene fraction (4*c*) exiting the oligomerisation unit (3) is sufficiently branched that it has good cold flow properties and does not require further refining in order to be blended into the final jet fuel product. The hydrocracker unit (8) is operated in accordance with the description of this invention, utilising a catalysts comprising a Group VI and a Group VIII metal on an aluminosilicate support under temperature conditions of 380-420° C. and pressure conditions of approximately 75 bar. The product stream (8*a*) is then routed to a fractionator (9), where:

- the $C_{1/2}$ fraction (9*a*) is routed to a fuel gas stream
- the $C_3$-$C_8$ fraction (9*b*) is routed to an LPG—$C_8$ stream
- the $C_9$ to $C_{15}$ fraction (9*c*) is combined with the $C_9$ to $C_{15}$ stream (5*a*) as the feed stream for the heavy paraffin reforming unit (6).
- any resultant $C_{16+}$ fraction (9*d*) is recycled to extinction back into the hydrocracker unit (8).

The heavy paraffin reforming (HPR) unit 6 is operated in accordance with the teachings of this invention under a temperature between 350° C. and 540° C.; and a pressure between 0.2 and 2 MPa. The reforming step is practised with a recycle rate of between 1.5 and 7. The product stream 6*a* is then routed to a fractionator 7, where:

- the $C_{1/2}$ fraction (7*a*) is routed to a fuel gas stream
- the $C_3$-$C_8$ fraction (7*b*) is routed to an LPG—$C_8$ stream
- the $C_9$ to $C_{15}$ fraction (7*c*) is routed to the final jet fuel product blend Table 1 below indicates the relative yields from the individual process steps; as well as the cumulative effect of these on final jet fuel product yield. The yield obtained from this example is at least 62%.

The jet fuel product of this example was found to have suitable properties, namely:

- an aromatic content more than 8 mass %; and hence a density greater than 0.775 $g \cdot cm^{-3}$.
- a freezing point less than −49° C.

EXAMPLE 2

The jet fuel refinery flow scheme used in this example is illustrated in FIG. 3. The flow scheme of Example 1 was modified to improve further on the jet fuel product yield.

The flow scheme is similar to that of Example 1, except that that the kerosene range material 9*c* exiting the hydrocracker 8 is routed directly to the final jet fuel product blend. The aromatics content and hence the density of jet fuel product blend is lower than is the case for Example 1. However, the yield of jet fuel product was increased to approximately 68%. The results are shown in table 2 below.

TABLE 1

Yield results for Example 1

| | Total LTFT feed | | Oligomerisation Feed | Oligomerisation Yield | Oligomerisation Product | HPR Feed | HPR Yield | HPR Product | Hydrocracking Feed | Hydrocracking Yield | Hydrocracking Product | Total product | |
|---|---|---|---|---|---|---|---|---|---|---|---|---|---|
| | % | Mass | Mass | % | Mass | Mass | % | Mass | Mass | % | Mass | Mass | % |
| Total | 100% | 100 | 17 | 100% | 17 | 68 | 100% | 68 | 57 | 100% | 57 | 100 | 100 |
| Fuel gas | 1% | 1 | | | | | 3% | 2 | | | | 3 | 3% |
| LPG | 2% | 2 | 2 | 10% | 2 | | 3% | 2 | | 2% | 1 | 5 | 5% |
| Naphtha ($C_5$-$C_8$) | 15% | 15 | 15 | 62% | 10 | | 9% | 6 | | 25% | 14 | 30 | 30% |
| Kero ($C_9$-$C_{15}$) | 27% | 27 | | 22% | 4 | 68 | 85% | 58 | | 73% | 41 | 62 | 62% |
| Wax $C_{16+}$ | 56% | 56 | | 6% | 1 | | | | 57 | | | | |

TABLE 2

Yield results for Example 2

| | Total LTFT feed | | Oligomerisation Feed | Oligomerisation Yield | Oligomerisation Product | HPR Feed | HPR Yield | HPR Product | Hydrocracking Feed | Hydrocracking Yield | Hydrocracking Product | Total product | |
|---|---|---|---|---|---|---|---|---|---|---|---|---|---|
| | % | Mass | Mass | % | Mass | Mass | % | Mass | Mass | % | Mass | Mass | % |
| Total | 101% | 100 | 17 | 100% | 17 | 27 | 100% | 27 | 57 | 100% | 57 | 100 | 100 |
| Fuel gas | 1% | 1 | | | | | 3% | 1 | | | | 2 | 2% |
| LPG | 2% | 2 | 2 | 10% | 2 | | 3% | 1 | | 2% | 1 | 4 | 4% |
| Naphtha ($C_5$-$C_8$) | 15% | 15 | 15 | 62% | 10 | | 9% | 2 | | 25% | 14 | 27 | 27% |
| Kero ($C_9$-$C_{15}$) | 27% | 27 | | 22% | 4 | 27 | 85% | 23 | | 73% | 41 | 68 | 68% |
| Wax $C_{16+}$ | 56% | 56 | | 6% | 1 | | | | 57 | | | | |

EXAMPLE 3

The jet fuel refinery flow scheme in this example is illustrated in FIG. 4. The flow schemes of Example 1 and Example 2 were modified to obtain a composite flow scheme which has an aromatic content (and hence a density) and yield intermediate between that obtained with Example 1 and Example 2. The final jet fuel product properties can be modified by selecting the appropriate flow ratios for the streams (9*g*) (which is routed directly to the final jet fuel product blend) and (9*h*) (which is combined with the straight run kerosene stream (5*a*) as the feed stream for the heavy paraffin reforming unit, (6) within a yield of between 62 and 68%.

For a final jet fuel product with a density of at least 0.775 $g \cdot cm^{-3}$; a final yield of approximately 66% of total product can be achieved in a single pass.

EXAMPLE 4

The jet fuel refinery flow scheme in this example is illustrated in FIG. 5. The flow scheme of Example 3 was modified with the inclusion of a further hydroisomerisation step.

The flow scheme is similar to that of Example 3, except that at least a portion of the kerosene range material (9*i*) exiting the hydrocracker 8 is routed through a hydroisomerisation unit (10). The product (10*a*) from the hydroisomerisation unit is sent to the final jet fuel product.

A second portion of the kerosene range material (9*h*) is combined with the straight run kerosene stream (5*a*) as the feed stream for the heavy paraffin reforming unit. The hydroisomerisation process is carried out under milder conditions than the HPR process, namely using a catalyst comprising a Group VIII metal on a molecular sieve support; at temperature conditions of 300-340° C. and pressure conditions of approximately 40 bar. As the reaction conditions are milder, the degree of cracking of the (9*i*) stream is much lower than is the case for the (9*h*) stream.

Final jet fuel product is obtained from this example flow scheme that has a density of at least 0.775 $g \cdot cm^{-3}$ and superior cold flow properties; at a yield of approximately 64% of total product.

All references cited herein are herewith incorporated by reference in their entirety.

The invention claimed is:

1. A process for producing jet fuel comprising the following steps:

A.1) separating from the product of a hydrocarbon synthesis process at least a portion of a $C_9$ to $C_{15}$ fraction and at least a portion of a $C_{16+}$ fraction;

A.2) converting at least a part of the separated $C_9$ to $C_{15}$ fraction to aromatic hydrocarbons, to obtain a jet fuel;

B.2) reducing the average number of carbon atoms of at least a portion of the separated $C_{16+}$ fraction;

adding at least a portion of the reduced separated $C_{16+}$ fraction to at least one of the $C_9$ to $C_{15}$ fraction separated from the hydrocarbon synthesis process and the separated $C_9$ to $C_{15}$ fraction subjected to conversion to aromatic hydrocarbons.

2. The process according to claim 1, wherein step A.2) is effected by dehydrocyclisation.

3. The process according to claim 1, wherein step A.2) is effected at a temperature within the range of 300° C. to 600° C.

4. The process according to claim 1, wherein step A.2) is effected at a pressure within the range of 0.1 to 2.5 MPa.

5. The process according to claim 1, wherein in step A.2) a catalyst comprising one or more catalytically active metals selected form ruthenium, rhodium, palladium, silver, osmium, iridium, platinum, tin and gold is used.

6. The process according to claim 1, wherein in step A.2) a supported catalyst is used.

7. The process according to claim 1, wherein the $C_9$ to $C_{15}$ fraction in step A.1) is separated from the product of the hydrocarbon synthesis process by distillation.

8. The process according to claim 1, further comprising the following step:

A.1.1) hydrotreating the portion of the $C_9$ to $C_{15}$ fraction separated in step A.1).

9. The process according to claim 1, further comprising the following step:

A.2.1) separating a $C_9$ to $C_{15}$ fraction from at least a portion of a product obtained from step A.2).

10. The process according to claim 1 whereby step B.2) is effected by at least one of catalytic cracking, hydrocracking and thermal cracking.

11. The process according to claim 1, further comprising the following steps:

C.1) separating at least a portion of a $C_3$ to $C_8$ fraction from the product of the hydrocarbon synthesis process;

C.2) increasing the average number of carbon atoms of at least a portion of the separated $C_3$ to $C_8$ fraction; and adding at least a portion of the increased separated $C_3$ to $C_8$ fraction to at least one of the $C_9$ to $C_{15}$ fraction separated from the hydrocarbon synthesis process and the separated $C_9$ to $C_{15}$ fraction converted to aromatic hydrocarbons.

12. The process according to claim 11 wherein step C.2) is effected by at least one of olefin oligomerisation and heavy aliphatic alkylation.

13. The process according to claim 1 wherein the hydrocarbon synthesis process is a Fischer-Tropsch process.

14. The process according to claim 13 wherein the Fischer-Tropsch process is a Low Temperature Fischer-Tropsch (LTFT) process.

15. A product obtainable by the process of claim 1.

16. The process of claim 1, further comprising:

B.3) separating a $C_9$ to $C_{15}$ fraction from at least a portion of a product produced by the reducing the average number of carbon atoms of at least a portion of the separated $C_{16+}$ fraction; and B.4) adding at least a portion of the $C_9$ to $C_{15}$ fraction separated in step B.3) to at least one of the $C_9$ to $C_{15}$ fraction separated from the hydrocarbon synthesis process and the separated $C_9$ to $C_{15}$ fraction converted to aromatic hydrocarbons.

17. The process of claim 11, further comprising

C.3) separating at least a portion of a $C_9$ to $C_{15}$ fraction from at least a portion of a product obtained from step C.2); and C.4) adding at least a portion of the separated $C_9$ to $C_{15}$ fraction obtained from step C.3) to at least one of the $C_9$ to $C_{15}$ fraction separated from the hydrocarbon synthesis process and the separated $C_9$ to $C_{15}$ fraction converted to aromatic hydrocarbons.

18. The process of claim 8 further comprising:

C.1) separating at least a portion of a $C_3$ to $C_8$ fraction from the product of the hydrocarbon synthesis process;

C.2) increasing the average number of carbon atoms of at least a portion of the separated $C_3$ to $C_8$ fraction; and adding at least a portion of the increased separated $C_3$ to $C_8$ fraction to the hydrotreated portion of the $C_9$ to $C_{15}$ fraction separated from the product of the hydrocarbon synthesis.

19. The process of claim 9 further comprising:

C.1) separating at least a portion of a $C_3$ to $C_8$ fraction from the product of the hydrocarbon synthesis process;

C.2) increasing the average number of carbon atoms of at least a portion of the separated $C_3$ to $C_8$ fraction; and adding at least a portion of the increased separated $C_3$ to $C_8$ fraction to the $C_9$ to $C_{15}$ fraction separated from the product obtained from step A.2).

20. The process of claim 8 further comprising:

C.1) separating at least a portion of a $C_3$ to $C_8$ fraction from the product of the hydrocarbon synthesis process;

C.2) increasing the average number of carbon atoms of at least a portion of the separated $C_3$ to $C_8$ fraction;

C.3) separating at least a portion of a $C_9$ to $C_{15}$ fraction from at least a portion of a product obtained from step C.2); and C.4) adding at least a portion of the separated $C_9$ to $C_{15}$ fraction to the hydrotreated portion of the $C_9$ to $C_{15}$ fraction separated from the product of the hydrocarbon synthesis.

21. The process of claim 8 further comprising:

C.1) separating at least a portion of a $C_3$ to $C_8$ fraction from the product of the hydrocarbon synthesis process;

C.2) increasing the average number of carbon atoms of at least a portion of the separated $C_3$ to $C_8$ fraction;

C.3) separating at least a portion of a $C_9$ to $C_{15}$ fraction from at least a portion of a product obtained from step C.2); and C.4) adding at least a portion of the separated $C_9$ to $C_{15}$ fraction to the $C_9$ to $C_{15}$ fraction separated from the product obtained from step A.2).

* * * * *